US006293173B1

(12) United States Patent
Rowlay

(10) Patent No.: US 6,293,173 B1
(45) Date of Patent: Sep. 25, 2001

(54) TOOL-BIT MAGAZINE FOR HAND TOOL

(75) Inventor: Stephen Rowlay, Sheffield (GB)

(73) Assignee: The Stanley Works Limited, Sheffield (GB)

( * ) Notice: Subject to any disclaimer, the term of this patent is extended or adjusted under 35 U.S.C. 154(b) by 0 days.

(21) Appl. No.: 09/357,086

(22) Filed: Jul. 19, 1999

(30) Foreign Application Priority Data

Aug. 3, 1998 (GB) ..... 9816876

(51) Int. Cl.[7] ..... B25G 1/08
(52) U.S. Cl. ..... 81/490; 81/177.4
(58) Field of Search ..... 81/490, 177.4

(56) References Cited

U.S. PATENT DOCUMENTS

| | | | |
|---|---|---|---|
| D. 358,316 | | 5/1995 | Markwart et al. . |
| 2,765,013 | | 10/1956 | Pedersen . |
| 3,006,395 | | 10/1961 | Dye . |
| 3,194,286 | | 7/1965 | Wagner . |
| 3,405,749 | | 10/1968 | Butler . |
| 3,753,455 | | 8/1973 | Butler . |
| 4,273,173 | | 6/1981 | Smith et al. . |
| 4,278,119 | * | 7/1981 | Elmore . |
| 4,463,788 | | 8/1984 | Corona et al. . |
| 4,480,668 | | 11/1984 | Lin . |
| 4,716,796 | | 1/1988 | Corona et al. . |
| 4,924,733 | | 5/1990 | McKenzie . |
| 5,427,003 | | 6/1995 | Boltak et al. . |
| 5,651,294 | | 7/1997 | Shiao . |
| 5,740,706 | | 4/1998 | Tseng . |
| 5,772,308 | | 6/1998 | Lin . |
| 5,782,146 | | 7/1998 | Lin . |
| 5,799,552 | * | 9/1998 | Curtis . |
| 5,832,791 | | 11/1998 | Lin . |
| 5,893,685 | | 4/1999 | Olson et al. . |
| 5,899,127 | * | 5/1999 | Shiao . |
| 5,947,212 | * | 9/1999 | Huang . |
| 6,007,277 | | 12/1999 | Olson et al. . |
| 6,050,158 | * | 4/2000 | Cassutti et al. . |

* cited by examiner

*Primary Examiner*—Timothy V. Eley
*Assistant Examiner*—Willie Berry, Jr.
(74) *Attorney, Agent, or Firm*—Pillsbury Winthrop LLP

(57) ABSTRACT

A sleeve is rotated to a position in which an aperture is in register with a tool-bit receiving recess in a body rotatably mounted on the shaft of a hand tool such as a screwdriver, so that a tool-bit can be removed from or inserted into that recess in a direction transverse to the axis of the shaft. The sleeve surrounds a rear end portion of the body so as to prevent escape of tool-bits from the recesses while leaving the tool-bits partly visible.

19 Claims, 3 Drawing Sheets

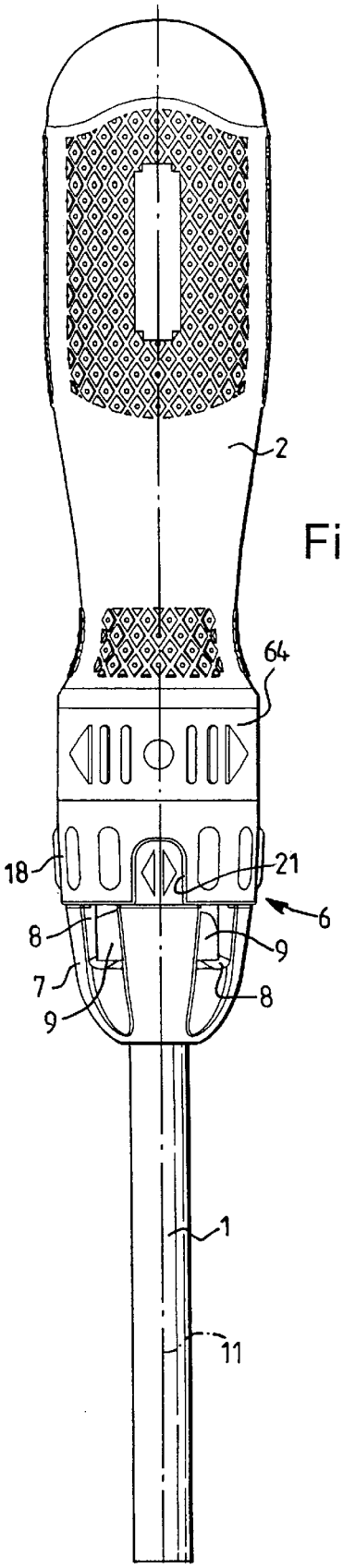
Fig. 4
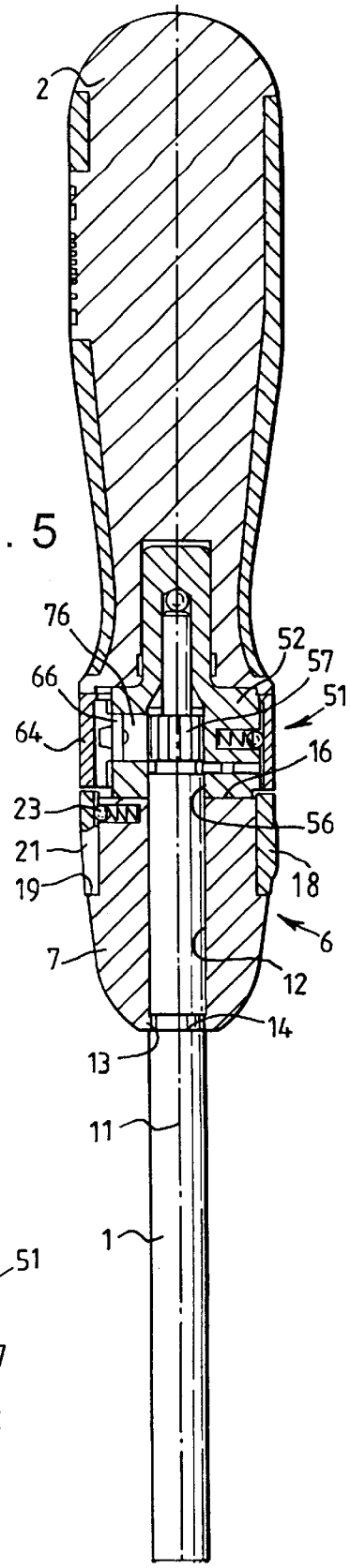
Fig. 5
Fig. 6
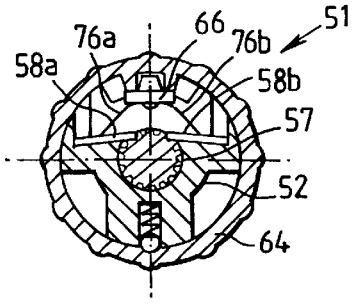

TOOL-BIT MAGAZINE FOR HAND TOOL

FIELD OF INVENTION

This invention relates to screwdrivers and other hand tools which may have replaceable tool-bits.

DESCRIPTION OF PRIOR ART

A large variety of fastening screws of various sizes, with different head types, e.g. slotted, Phillips, and Posidriv, are in use nowadays. These require a corresponding variety of screwdrivers or screwdriver bits. Bits may be selected from a storage unit and transferred to the chuck of a hand tool such as a cordless motorized screwdriver. The user has to remember to return the bits to the storage unit. It is inconvenient to use a succession of different bits at a location remote from the storage unit.

There are a large number of multi-bit screwdrivers on the market. Many of these store the bits loosely in a compartment in the handle, in which the bits may rattle noisily. In order to locate a particular bit it is usually necessary to removal all the bits from the compartment and to sort through them. Other multi-bit screwdrivers have the bits attached releasably to the front of the handle, in which case they are easily dislodged inadvertently.

SUMMARY OF THE INVENTION

The present invention provides a tool-bit magazine for a hand tool, having a body and a sleeve which are relatively rotatable to a position in which an aperture in the sleeve is in register with a recess in the body and thereby permits a tool-bit to be removed from or inserted into that recess.

BRIEF DESCRIPTION OF THE DRAWINGS

FIG. 4 is a side view of a preferred embodiment of the screwdriver;

FIG. 5 is an axial section through the screwdriver of FIG. 4; and

FIG. 6 is a cross-section through a ratchet mechanism in the screwdriver of FIG. 4.

DETAILED DESCRIPTION OF PREFERRED EMBODIMENTS

Figure 1:
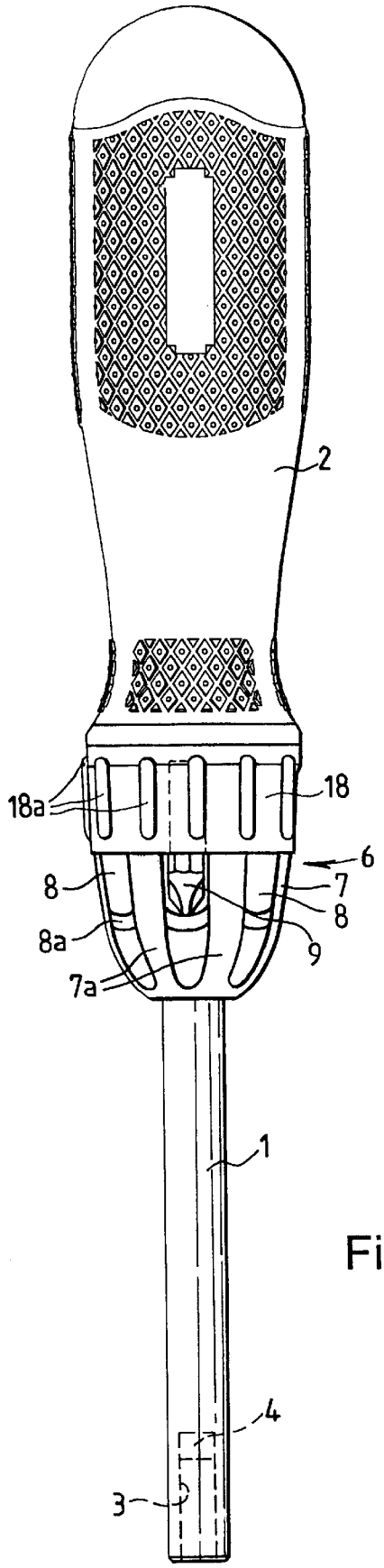
FIG. 1 is a side view of a multi-bit screwdriver incorporating a tool-bit magazine.
Figure 2A:
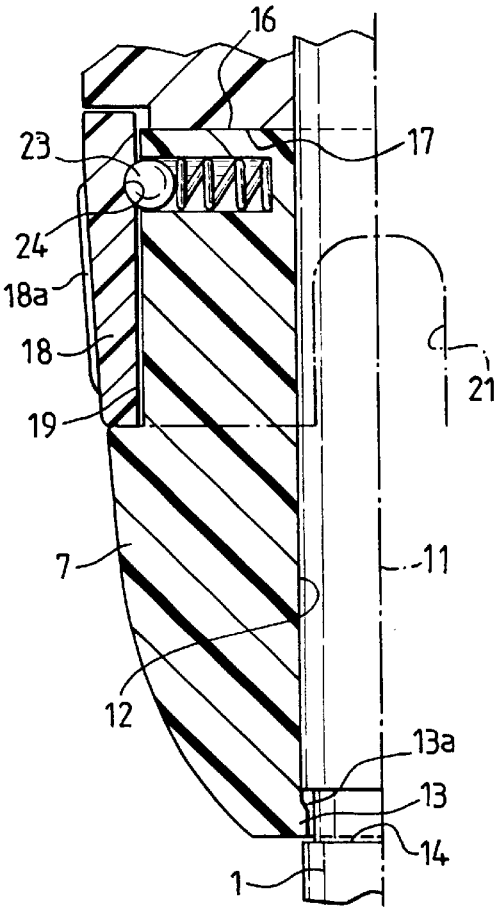
FIGS. 2*a* and 2*b* are axial sections through the magazine.
Figure 2B:
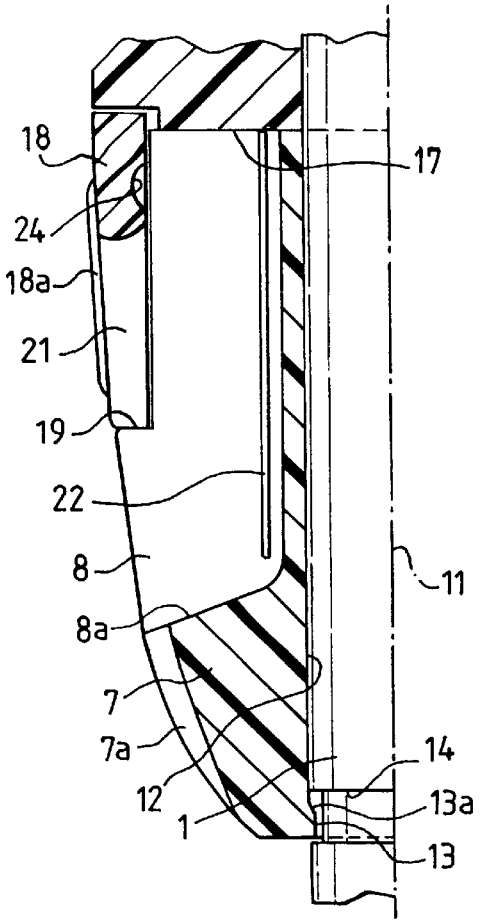

The screwdriver has a steel bar or shaft 1 which extends from one end of a composite plastics handle 2 having a hard polypropylene core. The bar is press formed with two longitudinal ribs (not visible) which retain the shaft 1 in the handle after the shaft has been pressed into the handle. The distal end of the shaft has a hexagonal recess 3 for receiving the hexagonal stub of a conventional tool-bit. A permanent magnet 4 is fixed in the base of the hexagonal recess 3 in order to retain the bit in use.

A tool-bit magazine 6 is mounted on the proximal end of the shaft 1. It has a body 7 with peripheral elongate recesses 8 for accommodating tool bits 9, one of which is visible in FIG. 1. The recesses 8 are spaced around the common axis 11 of the shaft 1 and the body 7 and they extend generally in the axial direction.

The body 7 has an axial bore 12 which is a sliding fit on the shaft 1. A radially inwardly projecting portion 13 of the body 7 engages in a circumferential groove 14 machined in the shaft 1, in order to retain the body 7 en the shaft 1. A bevel 13*a* on the inside edge of the projecting portion 13 allows the body 7 to be pushed on to the shaft 1. The rear end surface 16 of the body abuts against the front end surface 17 of the handle. The front end of each recess 8 is defined by a wall surface 8*a* sloping outwards away from the other end, which is open and which is covered by the front end surface 17 of the handle.

A sleeve 18 prevents escape of the bits 9 from the recesses 8. The sleeve 18 is mounted in a circumferential recess 19 in the body 7 so as to be rotatable to respective positions in which an aperture constituted by an open-ended slot 21 in the sleeve 18 is in register with a respective one of the recesses 8, thereby permitting a bit 9 to be inserted into that recess or removed from that recess (by allowing it to fall out under gravity). Since both the body 7 and the sleeve 18 are rotatable relative to the rest of the tool, it is necessary to hold one of them with one hand while the other hand rotates the other of them. For facilitate this, the body 7 and the sleeve 18 are provided with external ribs 7*a* and 18*a* respectively. Since the whole magazine 6 is rotatable, the shaft 1 can be guided firmly by one hand while the other hand rotates the handle 2, without any risk of the sleeve 18 being turned independently of the body 7 and inadvertently freeing the bits during use of the screwdriver.

Figure 3:
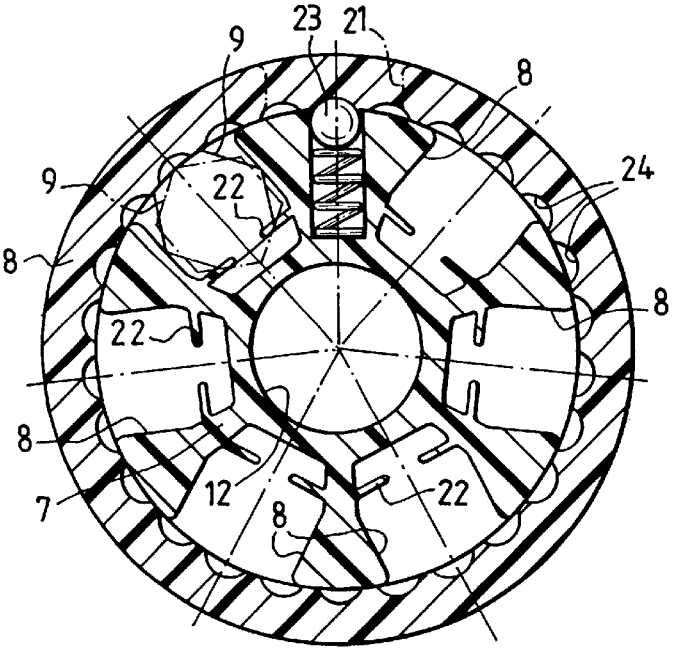
FIG. 3 is a cross-section through the magazine.

As can be seen from FIG. 1 particularly, the sleeve 18 only covers about half of the length of the recesses 8, with the result that the front ends of the bits 9 are visible so that they can be easily identified and selected. The rear end of the bit 9 rests against the front end surface 17 of the handle 2 and its tip rests against the sloping surface 8*a*. Rattling of the bits 9 in the recess 8 is prevented by flanges 22 which are formed integral with the body 7 and which are resiliently deformed by the bits 9 so that the bits are retained between the flanges 22 and the sleeve 18. As shown in FIG. 3, the hexagonal stub of the bit 9 is able to adopt different angular positions, two of which are indicated in solid line and chain line respectively.

In order to enable the sleeve 18 to be indexed and located in the respective positions in which the slot 21 registers with the respective recesses 8, a spring loaded ball 23 mounted in a radial bore in the body 7 cooperates with a circumferential series of part-spherical notches 24 in the sleeve 18.

Various modifications may be made within the scope of the invention. For example, a reversible ratchet mechanism for transmitting rotation from the handle 2 to the shaft 1 may be interposed between the magazine 6 and the handle 2.

FIGS. 4 to 6 show a preferred embodiment of the screwdriver, in which parts similar to those described above are given the same reference numerals. The screwdriver has a tool-bit magazine 6 with a body 7 having recesses 8 accommodating tool bits 9. The body 7 has an axial bore which is a sliding fit on the shaft 1. A portion 13 of the body 7 engages in a circumferential groove 14 machined in the shaft 1. A sleeve 18 is mounted in a circumferential recess 19 in the body 7 so as to be rotatable to respective positions in which a slot 21 is in register with a respective recess 8, to permit insertion or removal of a bit 9. A spring loaded ball 23 mounted on the body 7 engages in a circumferential series of notches in the sleeve 18.

The screwdriver shown in FIGS. 4 to 6 also has a ratchet mechanism 51 between the magazine 6 and the handle 2. The ratchet mechanism has a body 62 with a bore 56 receiving the shaft 1 which is formed with a spur gear 57 engageable by pawls 58*a* and 58*b* which are tiltable about axes parallel to the shaft axis 11. A control sleeve 64 is linked to a control member 66 carrying a leaf spring 76 with legs 76*a* and 76*b* which bear on the pawls 58*a* and 58*b* respectively. The control sleeve 64 is movable clockwise and anticlockwise from the intermediate position shown in FIG. 6, in which both pawls 58*a* and 58*b* and engaged with the gear 57, to respective ratcheting positions in which only one or the other of the pawls is engaged with the gear 57.

The rear end surface 16 of the magazine body 7 abuts against the front surface of the body 62, against which the rear ends of the bits 9 rest. The tips of the bits 9 rest against sloping front end surfaces 8*a* of the recesses 8.

The ratchet mechanism 51 is described in more detail in our U.K. Patent Application No. 9816878.4 entitled "Ratchet Mechanism" filed Aug. 3, 1998, and my U.S. Patent Application entitled "Ratcheting Driver" filed contemporaneously herewith, the contents of which are hereby incorporated by reference.

I claim:

1. A hand tool comprising a handle, a shaft extending from a front end of the handle, a front end portion of the shaft being adapted to mount a replaceable tool-bit, and a tool-bit magazine mounted on a rear end portion of the shaft, the magazine comprising a body which is separate from the handle and through which the shaft extends, the body having a plurality of elongate recesses for accommodating respective tool-bits, the elongate recesses being spaced around the longitudinal axis of the shaft and extending generally in an axial direction, the elongate recesses being open at a periphery of the body, a rear end portion of the body having a peripheral recess which is open toward the handle, and a sleeve which is mounted on the body and extends into the peripheral recess, the sleeve surrounding the rear end portion of the body and overlapping the elongate recesses so as to prevent escape of the tool-bits from the elongate recesses while leaving the tool-bits partly visible at front end portions of the elongate recesses remote from the handle, the sleeve having an aperture open at a periphery and at a front end of the sleeve remote from the handle, the sleeve being rotatable relative to the body to a position in which the aperture in the sleeve is in register with one of the elongate recesses and thereby permits a tool-bit to be selectively removed from and inserted into that recess in a direction transverse to the axial direction.

2. A hand tool as claimed in claim 1, in which the front end of each elongate recess remote from the handle is defined by a wall surface which slopes outwards and forwards.

3. A hand tool as claimed in claim 1, in which the magazine is rotatable relative to the shaft and the handle.

4. A hand tool as claimed in claim 3, in which the body has a radially inwardly projecting part engaging in a circumferential groove in the shaft.

5. A hand tool as claimed in claim 1, including indexing means for locating the sleeve in respective positions in which the aperture is in register with respective elongate recesses.

6. A hand tool as claimed in claim 1, including at least one resiliently deformable member in each elongate recess, said member being deformed by the tool-bit when inserted into the elongate recess, thereby to prevent rattling of the tool-bit.

7. A hand tool as claimed in claim 6, in which said member is a flange integral with the body.

8. A hand tool as claimed in claim 1, in which the body has a radially inwardly projecting part engaging in a groove in the shaft.

9. A hand tool comprising a handle, a shaft extending from a front end of the handle, a front end portion of the shaft being adapted to mount a replaceable tool-bit, and a tool-bit magazine mounted on a rear end portion of the shaft, the magazine comprising a body having a plurality of elongate recesses for accommodating respective tool-bits, the recesses being spaced around the longitudinal axis of the shaft and extending generally in an axial direction, the recesses being open at the periphery of a body, a sleeve which is mounted on the body, the sleeve surrounding a rear end portion of the body so as to prevent escape of the tool-bits from the recesses while leaving the tool-bits partly visible at front end portions of the recesses, the sleeve having an aperture open at a periphery and at a front end of the sleeve, the sleeve being rotatable relative to the body to a position in which the aperture in the sleeve is in register with one of the recesses and thereby permits a tool-bit to be selectively removed from and inserted into that recess in a direction transverse to the axial direction, and a spring-loaded element mounted on the body and cooperating with a circumferential series of notches in the sleeve to locate the sleeve in respective positions in which the aperture is in register with respective recesses.

10. A hand tool comprising a handle having a solid core, a shaft extending from a front end of the handle, a front end portion of the shaft being adapted to mount a replaceable tool-bit, and a tool-bit magazine mounted on a rear end portion of the shaft, the magazine comprising a body which is separate from the handle and through which the shaft extends, the body having a plurality of elongate recesses for accommodating respective tool-bits, the elongate recesses being spaced around the longitudinal axis of the shaft and extending generally in an axial direction, the elongate recesses being open at a periphery of the body, a rear end portion of the body having a peripheral recess which is open toward the handle, and a sleeve which is mounted on the body and extends into the peripheral recess, the sleeve surrounding the rear end portion of the body and overlapping the elongate recesses so as to prevent escape of the tool-bits from the elongate recesses while leaving the tool-bits partly visible at front end portions of the elongate recesses remote from the handle, the sleeve having an aperture open at a periphery and at a front end of the sleeve remote from the handle, the sleeve being rotatable relative to the body to a position in which the aperture in the sleeve is in register with one of the elongate recesses and thereby permits a tool-bit to be selectively removed from and inserted into that recess in a direction transverse to the axial direction.

11. A hand tool as claimed in claim 10, in which the front end of each elongate recess remote from the handle is defined by a wall surface which slopes outwards and forwards.

12. A hand tool as claimed in claim 10, in which the magazine is rotatable relative to the shaft and the handle.

13. A hand tool as claimed in claim 12, in which the body has a radially inwardly projecting part engaging in a circumferential groove in the shaft.

14. A hand tool as claimed in claim 10, including indexing means for locating the sleeve in respective positions in which the aperture is in register with respective elongate recesses.

15. A hand tool as claimed in claim 14, in which the indexing means comprises a spring-loaded element mounted on the body and cooperating with a circumferential series of notches in the sleeve.

16. A hand tool as claimed in claim 10, including at least one resiliently deformable member in each elongate recess, said member being deformed by the tool-bit when inserted into the elongate recess, thereby to prevent rattling of the tool-bit.

17. A hand tool as claimed in claim 16, in which said member is a flange integral with the body.

18. A hand tool as claimed in claim 10, in which the body has a radially inwardly projecting part engaging in a groove in the shaft.

19. A hand tool comprising a handle, a shaft extending from a front end of the handle, a front end portion of the shaft being adapted to mount a replaceable tool-bit, and a tool-bit magazine mounted on a rear end portion of the shaft, the magazine comprising a body which is separate from the handle and through which the shaft extends, the body having a plurality of elongate recesses for accommodating respective tool-bits, the elongate recesses being spaced around the longitudinal axis of the shaft and extending generally in an axial direction, the elongate recesses being open at a periphery of the body, a rear end portion of the body having a peripheral recess which is open toward the handle, and a sleeve which is mounted on the body and extends into the peripheral recess, the sleeve surrounding the rear end portion of the body and overlapping the elongate recesses so as to prevent escape of the tool-bits from the elongate recesses while leaving the tool-bits partly visible at front end portions of the elongate recesses remote from the handle, the sleeve having an aperture open at a periphery and at a front end of the sleeve remote from the handle, the sleeve being rotatable relative to the body to a position in which the aperture in the sleeve is in register with one of the elongate recesses and thereby permits a tool-bit to be selectively removed from and inserted into that recess in a direction transverse to the axial direction, wherein each of the elongate recesses include at least one resiliently deformable member, said member being deformed by the tool-bit when inserted into the elongate recess, thereby to prevent rattling of the tool bit.

* * * * *